US010785552B2

(12) United States Patent
Estabrook et al.

(10) Patent No.: US 10,785,552 B2
(45) Date of Patent: Sep. 22, 2020

(54) INTRA-AURAL AUDIO DEVICE HAVING MULTIPLE LAYERS

(71) Applicant: David Clark Company Incorporated, Worcester, MA (US)

(72) Inventors: Mark Estabrook, Acton, MA (US); Richard Urella, Grafton, MA (US)

(73) Assignee: David Clark Company Incorporated, Worcester, MA (US)

( * ) Notice: Subject to any disclaimer, the term of this patent is extended or adjusted under 35 U.S.C. 154(b) by 0 days.

(21) Appl. No.: 16/213,237

(22) Filed: Dec. 7, 2018

(65) Prior Publication Data

US 2019/0182577 A1 Jun. 13, 2019

Related U.S. Application Data

(60) Provisional application No. 62/596,481, filed on Dec. 8, 2017.

(51) Int. Cl.
*H04R 25/00* (2006.01)
*H04R 1/10* (2006.01)

(52) U.S. Cl.
CPC ..... *H04R 1/1016* (2013.01); *H04R 1/105* (2013.01); *H04R 1/1058* (2013.01); *H04R 25/652* (2013.01)

(58) Field of Classification Search
CPC .... H04R 25/65; H04R 25/652; H04R 25/658; H04R 2225/021; H04R 2225/023
See application file for complete search history.

(56) References Cited

U.S. PATENT DOCUMENTS

| | | | | |
|---|---|---|---|---|
| 3,890,474 | A * | 6/1975 | Glicksberg | A61F 11/08 381/72 |
| 5,333,622 | A * | 8/1994 | Casali | A61F 11/08 128/864 |
| 6,473,512 | B1 | 10/2002 | Juneau et al. | |
| 7,130,437 | B2 * | 10/2006 | Stonikas | H04R 25/652 381/322 |
| 8,897,458 | B2 | 11/2014 | Parkins et al. | |
| 9,398,362 | B2 * | 7/2016 | Hagen | H04R 1/1008 |
| 9,774,962 | B2 * | 9/2017 | Karamuk | H04R 25/652 |
| 2012/0237075 | A1 * | 9/2012 | East | H04R 1/1066 381/381 |
| 2018/0098163 | A1 * | 4/2018 | Barrett | H04R 1/1016 |

FOREIGN PATENT DOCUMENTS

| | | | |
|---|---|---|---|
| GB | 2537353 | A | 10/2016 |
| WO | 02/03757 | A1 | 1/2002 |
| WO | 2011/055367 | A1 | 5/2011 |

OTHER PUBLICATIONS

International Search Report and Written Opinion in corresponding International Application No. PCT/US2018/064492 dated Mar. 7, 2019; 10 pages.

* cited by examiner

*Primary Examiner* — Amir H Etesam
(74) *Attorney, Agent, or Firm* — Burns & Levinson LLP; Steven M. Mills

(57) ABSTRACT

An intra-aural audio device includes an outer layer shaped to define separate ear canal, concha bowl, and concha cymba portions. An inner layer is disposed within the outer layer, the inner layer having a durometer different than that of the outer layer.

22 Claims, 6 Drawing Sheets

INTRA-AURAL AUDIO DEVICE HAVING MULTIPLE LAYERS

CROSS REFERENCE TO RELATED APPLICATIONS

This application claims priority to and the benefit of U.S. Provisional Patent Application No. 62/596,481, filed on Dec. 8, 2017 and titled "INTRA-AURAL DEVICE", the contents of which are incorporated herein by reference as though fully set forth herein.

FIELD OF THE TECHNOLOGY

The subject disclosure relates to audio devices, and particularly to audio devices worn in the ear by a user.

BACKGROUND OF THE TECHNOLOGY

User's often rely on intra-aural devices (e.g. earbuds) to receive audio from a source (or sometimes to transmit audio). Key concerns of a user typically include having a device that is comfortable, while also having a device that is stable and remains in the user's ear without falling out. Depending on the environment within which the user intends to use the device, emphasis can be placed on different desired features (e.g. either comfort or remaining in place). One way to accomplish these goals is to design a device that is custom fitted to particular individual users by molding the device in accordance with that user's ear shape and desired comfort. However, customizing intra-aural devices to be suited to a particular user in this way can be time consuming and expensive, and is unrealistic for mass production. Another way is to use extraneous devices, such as a headband, or over the ear hooks, but these solutions are cumbersome for the user.

SUMMARY OF THE TECHNOLOGY

In light of the needs described above, in at least one aspect, the subject technology relates to an intra aural device using multiple layers and/or different materials which is configured to dynamically mold to a user's ear such that after insertion it remains inserted without the need for extraneous devices and is comfortable for long term use.

BRIEF DESCRIPTION OF THE DRAWINGS

So that those having ordinary skill in the art to which the disclosed system pertains will more readily understand how to make and use the same, reference may be had to the following drawings.

DETAILED DESCRIPTION

Figure 1:
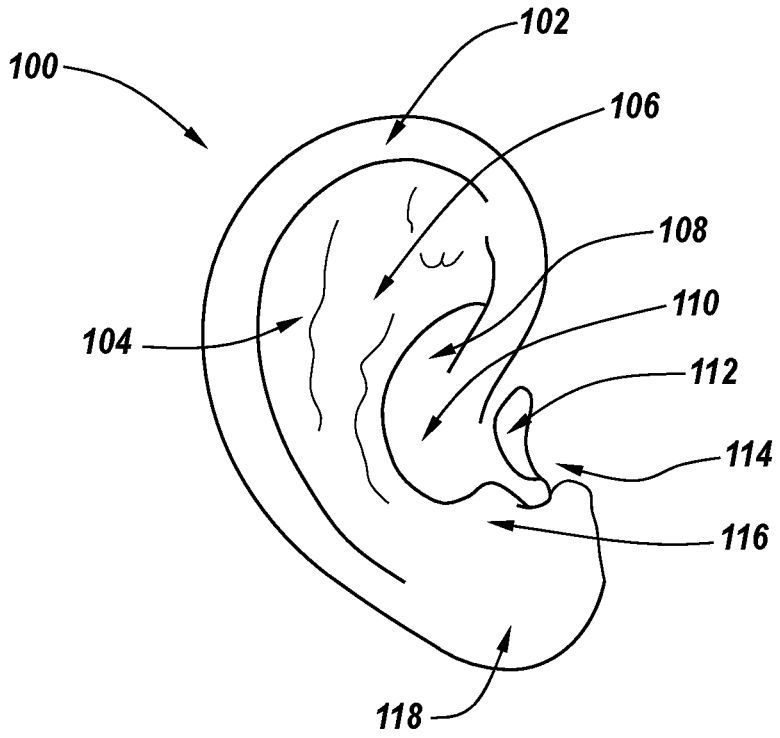
FIG. 1 is a side view of an exemplary human ear within which devices in accordance with the subject technology can be placed.

The subject technology overcomes many of the prior art problems associated with intra-aural audio devices. In brief summary, the subject technology provides an intra aura device that relies on multiple layers with different material properties to conform to the ear of a user within a grouping of basic sizes such as small, medium and large. The advantages, and other features of the systems and methods disclosed herein, will become more readily apparent to those having ordinary skill in the art from the following detailed description of certain preferred embodiments taken in conjunction with the drawings which set forth representative embodiments of the subject technology. Like reference numerals are used herein to denote like parts. Further, words denoting orientation such as "upper", "lower", "distal", and "proximate" are merely used to help describe the location of components with respect to one another. For example, an "upper" surface of a part is merely meant to describe a surface that is separate from the "lower" surface of that same part. No words denoting orientation are used to describe an absolute orientation (i.e. where an "upper" part must always be on top).

Referring now to FIG. 1, a front view of a right ear 100 is shown. FIG. 1 is provided to identify portions of an ear 100 and the terms used herein to describe them to better understand how a device in accordance with the subject technology interacts with the ear 100. The ear 100 includes a helix 102, a scapha 104, an antihelix 106, a concha cymba 108, a concha bowl 110, an ear canal 112, a tragus 114, an antitragus 116, and a lobule 118. Generally, the terms used herein to describe the ear 100 should be understood in accordance with their normal meaning except where a contrary description is given herein.

Figure 2:
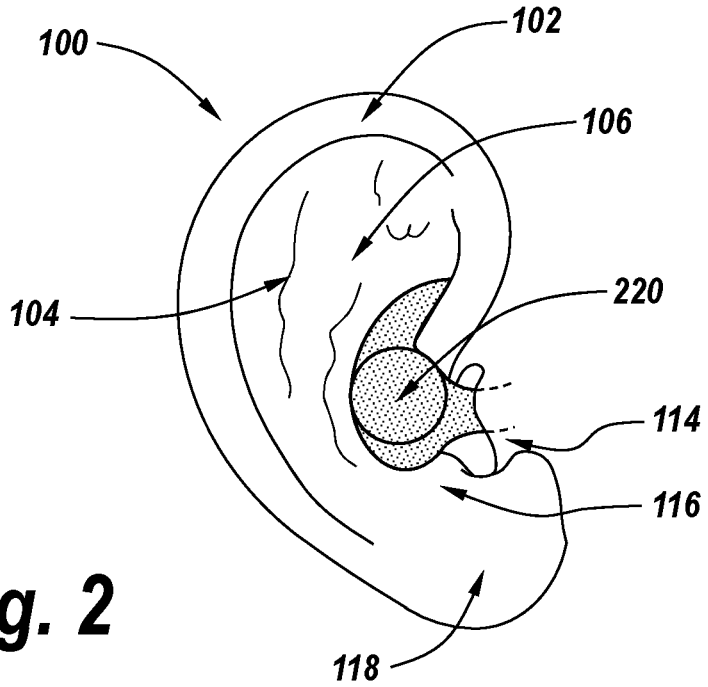
FIG. 2 is a side view of the ear of FIG. 1 within which there is a device in accordance with the subject technology.

Referring now to FIG. 2, a front view of a device 220 in accordance with the subject technology is shown placed within the right ear 100 and in use. The primary contact points between the device 220 and the ear 100 are in the ear canal 112, concha bowl 110, and concha cymba 108. It should be understood that the device 220 shown and described herein is an exemplary device for a right ear but could also be configured for placement in the left ear, the device configured for placement in the left ear being structurally a mirror image of the device 220 shown. Further, devices for both left and right ear can be included in a set and configured electronically to act together to provide features such as mono or stereo sound, surround sound, noise cancellation, or the like.

Figure 3:
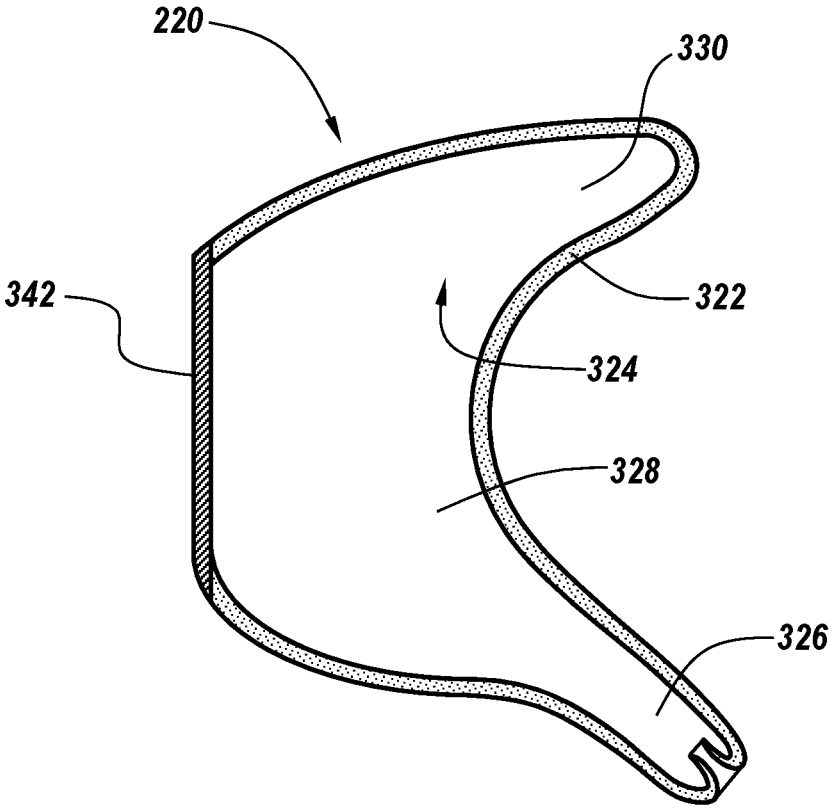
FIG. 3 is a side cross-sectional view of a device in accordance with the subject technology.

Referring now to FIG. 3, a cross-sectional view of the intra-aural audio device 220 is shown. The intra-aural audio 220 device includes materials with certain properties designed to provide advantages for the user including comfort, stability, ability to stay in a user's ear, and/or audio quality. The device 220 is divided into two layers; an outer layer 322 and an inner layer 324. It should be understood that since FIG. 3 is a cross sectional view, the outer layer 322 actually surrounds the entire inner layer 324. The outer layer 322 can be formed from a non-allergenic material such as Silicone, Buna-N(Nitrile), other synthetic rubber copolymers of acrylonitrile and butadiene, or the like. These materials are inert and considered safe for human contact while being available in differing durometers. Similarly, the inner layer 324 can be formed from one of the non-allergenic material similar to those that can be used for the outer layer 322. Alternatively, the inner layer 324 can be formed from interlocking granules within a liquid, as will be described in more detail below.

The outer layer 322 can have different material properties than the inner layer 324 to achieve the goals of the subject technology. For example, the outer layer 322 can have a higher durometer to provide structural stability while the inner layer 324 can have a lower durometer, allowing the device 220 to flex when placed within the user's ear thus conforming to the idiosyncrasies of an individual ear, before expanding and applying force to the user's ear such that it does not fall out during use. An outer layer 322 with a durometer between 20-50 Shore A and an inner layer 324 with a durometer between 10-30 Shore-OO has been found to be effective.

The device 220 can also be described as broken up into different portions corresponding to different portions of the user's ear, depending on the desired properties of the device in those regions. The device 220 shown has an ear canal portion 326 designed to rest within the ear canal of a user. The device also has a concha bowl portion 328 and a concha cymba portion 330, designed to rest against the concha bowl and concha cymba, respectively, of a user's ear.

In some environments, there may be a desire to maximize the grip of the device 220 to focus on stability and/or the self-retaining nature of the intra-aural device. Such an environment might arise when the device 220 will be used only short term or in a high impact, high weight, or highly leveraged weight (e.g. a large attached boom microphone) environment. In this case, the design features ensure the device 220 is self-retaining and remains within the ear without assistance from external components, such as hooks around the outside of the ear, a headband, or other supportive structures (however, in some extreme cases, external components could be added for additional support).

A device 220 configured to emphasize grip strength can leverage the ear canal of the user as a gripping surface and include an ear canal portion 326 configured accordingly. While the ear canal can be used as an effective gripping surface, it is also very sensitive. As a result, the device 220 must be configured carefully to achieve the desired goals of maximizing grip strength while still being comfortable. To that end, the ear canal portion 326 be of a length of between 10-12 mm. Normally, in a standard design, the ear canal portion tends to be between 8-10 mm in length. The ear canal portion 326 can also include flexible ribs (not distinctly shown) which extend longitudinally either straight or in a twisting fashion around and outward from the outer layer 322 of the ear canal portion 326. The flexible ribs have a durometer of less than 20-50 Shore A and are designed to flex when the device 220 enters the ear canal of the user. However, the ribs have enough rigidity that after the device 220 is placed within the ear, the ribs provide a compression force against the wall of the ear canal to further contribute to holding the device 220 within the ear. The portion of the outer layer 322 forming the ear canal portion 326 can have a thickness between 1-2 mm to support the ribbing. The inner layer 324 within the ear canal portion 326 can have a durometer greater than that of the outer layer 322, and particularly between 30-60 Shore A. This way, the inner layer 324 of the ear canal portion 326 provides structural stability and is stiffer, while the outer layer 322 is more easily compressed and provides a softer feel against the ear canal of the user. In some cases, flexible circumferentially formed rings can also be used instead of flexible ribs.

The concha cymba portion 330 can also be designed to maximize grip strength. In general, a stiffer concha cymba portion 330 improves the device's 220 grip once inserted into the ear but higher compressibility results in a better fit. In some cases, the outer layer 322 of the concha cymba portion 330 can be divided into a first portion and a second portion. While the first portion and second portion are not distinctly shown, the first portion can be substantially the half of the outer layer 322, by volume, that is closest to the inner layer 324 while the second portion can be the half distal to the inner layer 324 (i.e. on the exterior of the device 220). The second portion can be formed from a soft material, having a durometer between 5-15 Shore-OO while the first portion can be formed from a stiffer material, having a higher durometer between 50-70 Shore A.

Likewise, the concha bowl portion 328 can be configured for an environment where maximizing grip strength is desired. Again, materials of different stiffness are used to conform to idiosyncrasies of a variety of ear anatomies. As such, the portion of the outer layer 322 which defines the concha bowl 328 can have a durometer between 20-40 Shore A and a thickness of between 1-2 mm. This results in a durable concha bowl portion 328 while also allowing this area of the device 220 to effectively conform to the shape of the concha bowl of the user's ear. The inner layer 324 within the concha bowl portion 328 can then be of a lesser durometer, such as a durometer between 10-30 Shore-OO which allows for compressibility. This provides for sufficient deformation when the user inserts the device 220 into their ear such that the concha bowl portion 328 of the device 220 can match the concha bowl of the user's ear in terms of shape and volume. More particularly, when the device 220 is pressed against the ear of the user, the inner layer 324 will allow the device 220 to initially compress. The device 220 will then push back against the user's ear, creating friction which resists removal of the device 220 from the ear.

Figure 4:
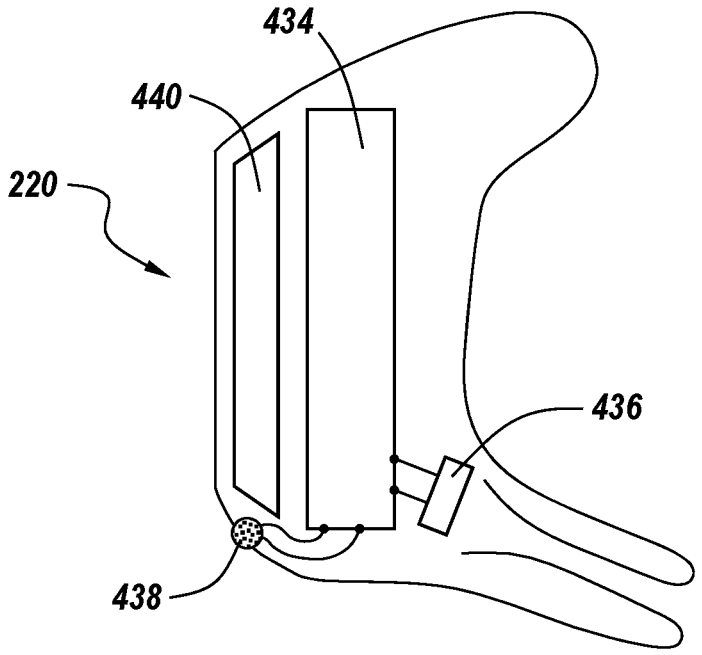
FIG. 4 is a side cross-sectional view of a device in accordance with the subject technology.

In some arrangement, this inner layer 324 actually serves as a middle layer within the concha bowl portion 328, with a further innermost layer being included (not distinctly shown). The innermost layer can firmly support scaffolding for internal electronics at a fixed location within the device 220. The scaffolding then attaches to, and prevents undue movement of, internal electronics that drive the audio functionality of the device during insertion of the device into the user's ear. For example, turning to FIG. 4, scaffolding (not distinctly shown) would be provided within the device 220 to support one or more pieces of the functional equipment shown, including an audio tube 532, electronics 434 (i.e. microprocessors, receivers/transmitters, etc.), a speaker 436, a microphone 438, a battery 440, or the like at a fixed locations within the intra-aural device. Likewise, the scaffolding could support other electronics that drive the functionality of the device 220.

Referring again to FIG. 3, a rigid cap 342 can also be included distal to the concha bowl portion 328 which is configured to be gripped by the user for easy insertion and removal of the device 220. The cap 342 can be of a particularly high durometer, such as a higher durometer than the outer layer 322 of the device 220 (e.g. a rigid plastic), as the area upon which the cap 342 is located does not come in contact with the ear and so compression of the cap 342 is not necessary for maximizing comfort or achieving a good fit. The rigid cap 342 can also serve as a structural support, attaching to the inner support scaffolding described above.

In other environments, it may be desirable to have an intra aural audio device 220 which places a greater emphasis on comfort than on the grip strength of the device 220. For example, in low impact environments or for a low weight or lightly leveraged weight (e.g. small or no boom microphone), the device 220 falling out of the user's ear may not be as large of a risk or concern. Various modifications can be made to features of the device 220 to emphasize comfort, as will be discussed in more detail below.

The ear canal portion 326 can be modified to maximize comfort by shortening the ear canal portion 326 to a range of 6-8 mm in length to be less intrusive. The device 220 can be provided with a smooth outer layer 322 having a durometer of less than 50 Shore A in the ear canal portion 326. The smooth outer layer 322 allows the forces from the device to be distributed evenly across the inner ear canal wall. The corresponding inner layer 324 can be a durometer of between 10-40 Shore-OO to provide flex with mouth movements and overall comfort. To maximize comfort, similar material properties can also be included in the inner layer 324 and outer layer 322 across the entire device 220, rather than just in the ear canal portion 326.

Figure 5:
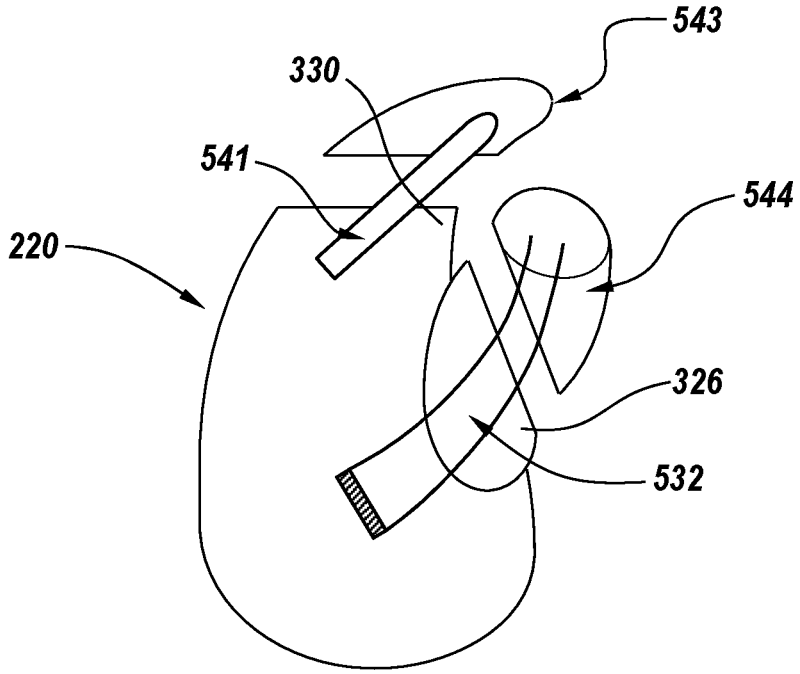
FIG. 5 is an overhead view of a device in accordance with the subject technology.

Referring now to FIG. 5, other design features of the device 220 can also be included. In particular, the device 220 is shown including detachable tips 543, 544 in both the concha cymba portion 330 and in the ear canal portion 326. While the device itself 220 is generally designed to mold to the ear of the user, including replaceable tips 543, 544 allows the device 220 to be provided to a user with a selection of tips of different shapes and sizes so that a portion of the device 220 can be customized to fit the user's ear. In the example shown, the concha cymba tip 543 is held to the device 220 by a holding pin 541, while the ear canal tip 544 is held to the device 220 by an audio tube 532, although other means of coupling the tips to the device 220 could also be used. The replaceable tips 543, 544 additionally allow a user to quickly clean or replace those sections of the device 220 with new tips, those sections tending to have a significant amount of contact with the user's ear.

Figure 6:
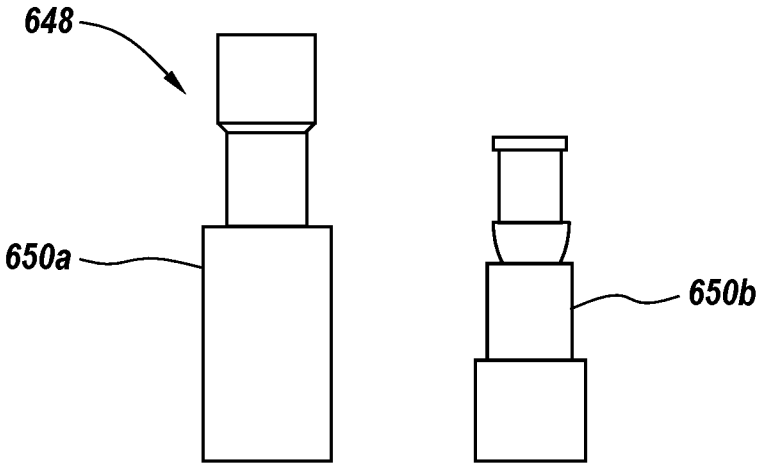
FIG. 6 is a front view of a bullet connector for a device in accordance with the subject technology.

Referring now to FIG. 6, an exemplary detachable bullet connector 648 in accordance with the subject technology is shown. The detachable bullet connector 648 includes two end pieces 650*a*, 650*b* which removably couple together. The detachable bullet connector 648 can be placed within a portion of the inner layer of the intra-aural device within the ear canal portion. The geometry of the concha cymba of an ear lends itself to being designed such that different sized concha cymba portions may be attached to the main intra aural device to accommodate different sizes (much in the same way different sized tips can be provided). Therefore the bullet connector 648 can be formed from high durometer material, such as a hard plastic or even a metal to allow a user to disconnect and replace the concha cymba portion with a concha cymba portion that is a better fit, if they so desired. The bullet connector 648 could also be a high durometer silicone or Buna-n material.

Figure 7:
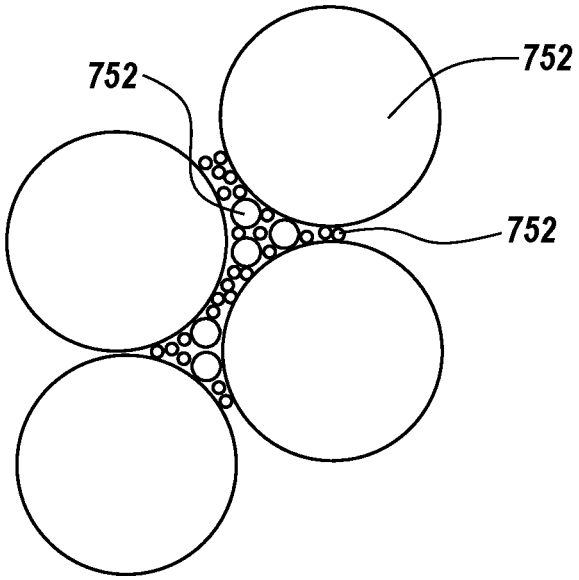
FIG. 7 shows an exemplary material for a layer of a device in accordance with the subject technology.

Referring now to FIG. 7, an exemplary inner layer material is shown. The inner layer material can act as a filler, filling in the outer layer after the outer layer has formed a shell. In the example of FIG. 7, the inner layer is comprised of interlocking granules 752. Various materials have been found to be effective for the interlocking granules 752, including Silicone and Buna-N, as well as plastic, glass, and ceramic materials. However, this list is by no means all inclusive, and other materials that exhibit the interlocking properties described herein could also be used. There are several features which allow the granules 752 to interlock, which are discussed in more detail below. Overall, utilizing an inner material comprising interlocking granules 752 is effective in allowing the device to mold to the unique ear anatomy of each user and retain itself in the user's ear. Upon insertion of the device into the user's ear with some degree of force applied by the user, the filler will conform to the shape of the user's unique ear structure (particularly by the ear canal and concha bowl of the user's ear on the corresponding regions of the device). After the initial force of application is removed the device 220 will resist changing shape due to the properties of the filler material, and will thus tend to stay in place within the user's ear much like a traditional custom fitted hearing aid. This avoids the need for configuring a device that is custom designed to a particular user's ear, such as by designing the device with a particular shape for a certain user, because the device shape is dynamic and can mold to the ear upon insertion.

In the example of FIG. 7, difference sized granules 752 are used to cause the granules to interlock. Notably, FIG. 6 is exemplary of interlocking granules 752 which are shown as different sized spheres, but FIG. 6 is not drawn to scale. The largest granules 752 can be of a size that is smaller than the necessary degree of conformance of the intra-aural device to achieve a custom shape sufficient to hold the device in place within the ear. In some cases, an effective size of the largest granules 752 can be between 1-1.5 mm, and/or less than 1.5 mm. These large granules 752 can encompass 2-25 percent by volume of the total interlocking granules 752 in the inner layer. A second grouping of smaller granules 752 can then be provided at an amount between 5-40 percent by volume. The second grouping of granules 752 can have a size between 25-50 percent of the large granules 752. A grouping of third granules 752 can also be included that is even smaller than the second grouping of granules 752. The third grouping can have a size between 5-25 percent of the second size, and be provided at an amount between 40-90 percent by volume.

Notably, the inner layer is configured with a focus on creating a layer that shifts to mold to the ear when inserted, but remains in place once the insertion force is removed. Movement of the granules 752 is dictated solely by the level of friction between the granules 752. Once in motion, both friction and the effects of inelastic collisions dictate the movement of the granules 752. The dynamics of movement within the inner layer are of less of a concern, since movement occurs only during insertion and/or removal. However, any friction which prevents movement of the granules 752 after placement also tends to prevent their movement in the first place. Therefore the subject technology is directed at balances of granules 752 and liquid content that effectuates these goals.

It should be understood that while spherical interlocking granules 752 are shown in FIG. 7, other shapes can be used as well. Irregular shapes, such as oblong or sharp and/or angled granules (e.g. non-spherical) will tend to create more interlocking within the material. The cost of manufacture of non-round shapes may be higher than round shapes. There can also be some dulling of the sharp granules over time, causing a reduction in locking ability. Therefore the choice of granule depends upon the cost of manufacturing the irregular shapes and for the sharp edged granules one must also consider the degree of sharpness and/or total amount of sharp spheres and the desired life cycle of the device.

Figure 8A:
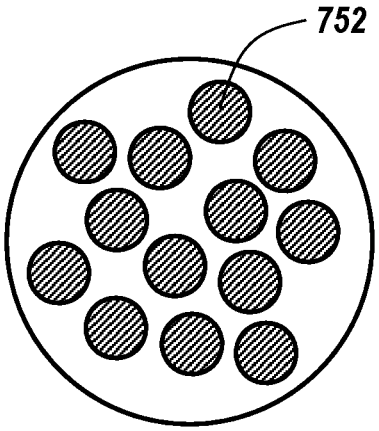
FIGS. 8*a*-8*e* shows exemplary materials for a layer of a device in accordance with the subject technology.
Figure 8B:
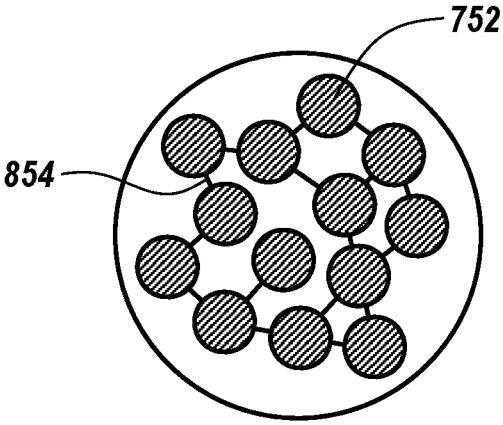
Figure 8C:
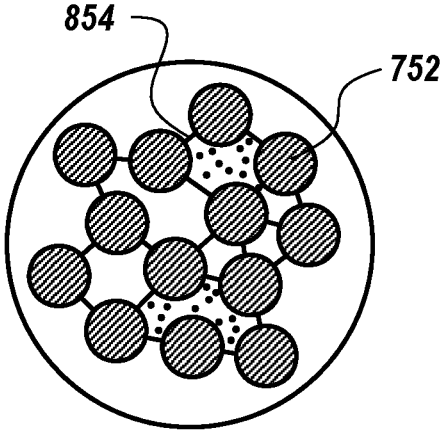
Figure 8D:
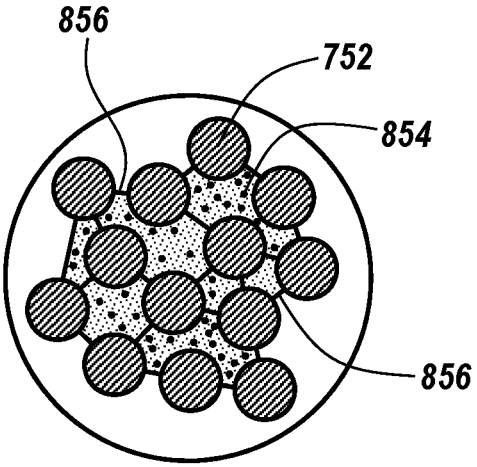
Figure 8E:
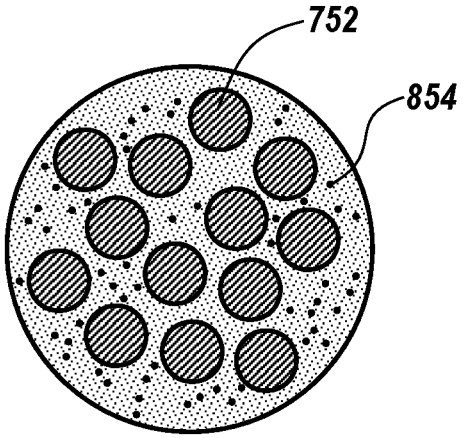

Referring now to FIGS. 8*a*-8*e*, the interlocking granules 752 can also be disposed within a liquid 854. FIGS. 8*a*-8*e* show various degrees of saturation of the material (i.e. various percentages of liquid 854 by volume), with FIG. 8*a* showing dry granules 752 and FIG. 8*e* showing the most saturated granules 752. In FIG. 8*a*, the inner layer material shown is comprised of only granules 752 in a dry state which results in negligible cohesion between the granules 752. In the dry state, the dominant interactions between the granules are inelastic collisions and friction which are non-cohesive forces. An ear bud design using a dry sphere approach relies entirely on a high level of friction between granules 752.

When the inner layer includes liquid 854 in addition to granules, as seen in FIGS. 8*b*-8*e*, other forces are added which change the behavior of the granules 752. These include cohesion due to surface tension between the granules 752 and the liquid 854, lubrication, and viscosity. Lubrication and viscosity are more influential in dynamic motion, therefore the inner layer of the device of the subject technology is configured with a focus on cohesion. Cohesion is determined primarily by surface tension and capillary action. Cohesion occurs in wet granular material unless the liquid content is too high, such as when there is total immersion of the granules 752 in liquid 854 (see FIG. 8*e*). Through cohesion, granules 752 surrounded by some liquid 854, but not completely immersed, can provide benefits including greater hysteresis in packing and enhanced strength again loading. Cohesion in a wet granular material comes from surface tension and capillary effects associated with the liquid 854 against the granules 752. The liquid menisci contribute to cohesion according to the sum of the surface tension and suction as the liquid 854 tries to minimize its surface area. Particular consideration is given herein to the 'bridge' that forms between two granules 752 during certain material states. At times, the material properties are also described in terms of viscosity rather than cohesion. The viscosity of a liquid quantifies its resistance to flow. Liquids that have strong intermolecular forces tend to have high viscosities. As discussed in more detail below, effective materials in accordance with the subject technology are selected to achieve a desired cohesion (i.e. surface tension and capillary action) and/or viscosity. For example, the inner layer has been found to be effective, in certain cases, when the viscosity of the inner layer is greater than 100 megapoises.

In FIG. 8*b*, the granules 752 are surrounded by a lower liquid 854 content, resulting in a pendular state. In the pendular state, liquid 854 bridges are formed at the contact points of grains and cohesive forces act through the liquid 854 bridges. In FIG. 8*c*, the granules 752 are surrounded by a medium liquid 854 content resulting in a funicular state. In the funicular state, liquid 854 bridges around the contact points and liquid-filled pores coexist, both giving rise to cohesion between particles. In FIG. 8*d*, the granules 752 are almost saturated with liquid 854 and are in a capillary state. In the capillary state, almost all pores (i.e. the volume between the granules 752) are filled with liquid 854, but the liquid surface 856 forms menisci and the liquid 854 pressure is lower than the air pressure. This causes suction which results in a cohesive interaction between granules 752. In FIG. 8*e*, the granules 752 contain even a higher liquid 854 content than in FIG. 8*d* and the granules 752 are in a slurry state. In the slurry state, the liquid 854 pressure is equal to, or higher than, the air pressure. No cohesive interaction appears between granules 752

Figure 9:
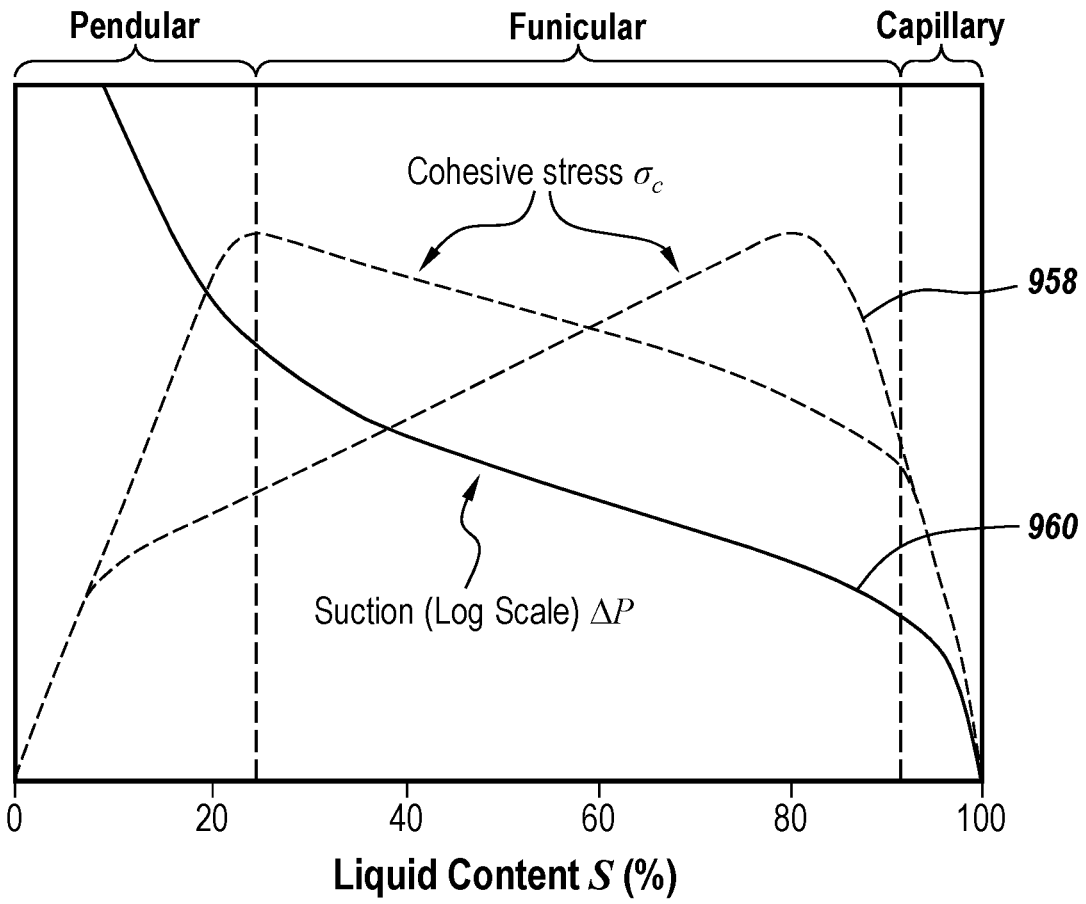
FIG. 9 is a graph of various forces by liquid content for materials in accordance with the subject technology.

Referring now to FIG. 9, cohesive stress 958 and suction forces 960 are shown graphed against liquid content of the inner layer material as a percentage of volume (x axis). In some cases, devices in accordance with the subject technology can have an inner layer with a liquid content that places the material in the higher end of the pendular state, where there are high cohesive forces, and particularly where there is a cross-over between the cohesive and suction forces. This can occur when the liquid content is between 15-25 percent by volume. Therefore an inner layer with a liquid content between 15-25 percent by volume has been found to be effective.

All orientations and arrangements of the components shown herein are used by way of example only. Further, it will be appreciated by those of ordinary skill in the pertinent art that the functions of several elements may, in alternative embodiments, be carried out by fewer elements or a single element. Similarly, in some embodiments, any functional element may perform fewer, or different, operations than those described with respect to the illustrated embodiment. Also, functional elements (e.g. electronics and the like) shown as distinct for purposes of illustration may be incorporated within other functional elements in a particular implementation.

While the subject technology has been described with respect to preferred embodiments, those skilled in the art will readily appreciate that various changes and/or modifications can be made to the subject technology without departing from the spirit or scope of the subject technology. For example, each claim may depend from any or all claims in a multiple dependent manner even though such has not been originally claimed.

What is claimed is:

1. An intra-aural audio device comprising:

an outer layer shaped to define an ear canal portion, a concha bowl portion, and a concha cymba portion; and an inner layer disposed within the outer layer, the inner layer having a durometer different than that of the outer layer, wherein:

the ear canal portion is between 6-8 mm in length;

a portion of the outer layer defining the ear canal portion has a smooth outer surface and a durometer of less than 50 Shore A; and a portion of the inner layer within the ear canal portion has a durometer of 10-40 Shore-OO.

2. The intra-aural audio device of claim 1, wherein the outer layer comprises a non-allergenic material.

3. The intra-aural audio device of claim 1, wherein the inner layer comprises a non-allergenic material.

4. The intra-aural audio device of claim 1, wherein the outer layer is one of: Silicone; or Buna-N.

5. The intra-aural audio device of claim 1, wherein the inner layer is one of: Silicone; or Buna-N.

6. The intra-aural audio device of claim 1, further comprising scaffolding within the inner layer, the scaffolding supporting an audio tube, a pressure relief tube, a speaker, and a microphone at a fixed locations within the intra-aural audio device.

7. The intra-aural audio device of claim 1 further comprising a rigid cap located distal to the concha bowl portion and configured to be gripped by a user.

8. An intra-aural audio device comprising:

an outer layer shaped to define an ear canal portion, a concha bowl portion, and a concha cymba portion; and an inner layer disposed within the outer layer, the inner layer having a durometer different than that of the outer layer, wherein:

the ear canal portion is between 10-12 mm in length;

a portion of the outer layer defining the ear canal portion has a thickness between 1-2 mm and a durometer of less than 20-50 Shore A; and a portion of the inner layer within the ear canal portion has a durometer greater than the portion of the outer layer defining the ear canal portion and between 30-60 Shore A.

9. The intra-aural audio device of claim 8, wherein the outer layer comprises circumferentially formed rings with a durometer of less than 20-50 Shore A.

10. The intra-aural audio device of claim 1, further comprising a detachable bullet connector within a portion of the inner layer within the concha cymba portion.

11. The intra-aural audio device of claim 1, wherein the ear canal portion is configured to removably couple to a tip.

12. The intra-aural audio device of claim 8, wherein:

a portion of the outer layer defining the concha cymba portion comprises a first portion proximate to the inner layer and a second portion distal to the inner layer, the first and second portion each being substantially half of a total volume of the outer layer;

the first portion has a durometer between 50-70 Shore A; and the second portion has a durometer between 5-15 Shore-OO.

13. An intra-aural audio device comprising:

an outer layer shaped to define an ear canal portion, a concha bowl portion, and a concha cymba portion, the outer layer comprising a non-allergenic material; and an inner layer disposed within the outer layer, the inner layer having a durometer different than that of the outer layer, wherein the inner layer is a filler material comprising interlocking granules disposed within a liquid.

14. The intra-aural audio device of claim 13, wherein each of the interlocking granules are less than 1.5 mm in diameter.

15. The intra-aural audio device of claim 13, wherein there interlocking granules comprise: between 2-25 percent by volume interlocking granules of a first size; between 5-40 percent by volume interlocking granules of a second size; and between 40-90 percent by volume interlocking granules of a third size, wherein:

the first size is less than 1.5 mm;

the second size is between 25-50 percent of the first size; and the third size is between 5-25 percent of the second size.

16. The intra-aural audio device of claim 13, wherein the inner layer contains a liquid content of between 15-25 percent by volume resulting in a pendular state.

17. The intra-aural audio device of claim 13, wherein a plurality of the interlocking granules include sharp edges.

18. The intra-aural audio device of claim 13, wherein the inner layer is a material of a viscosity greater than 100 megapoises.

19. The intra-aural audio device of claim 8, wherein:

a portion of the outer layer defining the concha bowl portion has a thickness between 1-2 mm and a durometer between 20-40 Shore A; and a portion of the inner layer within the ear canal portion has a durometer between 10-30 Shore-OO, wherein the intra-aural audio device further comprises an innermost layer within the portion of the inner layer within the ear canal portion, the innermost layer having a durometer greater than the inner layer and supporting scaffolding, the scaffolding supporting an audio tube, a pressure relief tube, a speaker, and a microphone at a fixed locations within the intra-aural audio device.

20. The intra-aural audio device of claim 13, wherein a plurality of the interlocking granules are shaped to be one of: oblong; or non-spherical.

21. The intra-aural audio device of claim 1, wherein the outer layer is smooth and has a durometer of less than 50 Shore A in the ear canal portion, the concha bowl portion, and the concha cymba portion; and the inner layer has a durometer of 10-40 Shore-OO in the ear canal portion, the concha bowl portion, and the concha cymba portion.

22. The intra-aural audio device of claim 13, the ear canal portion comprises flexible ribs with a durometer of less than 20-50 Shore A.

* * * * *